United States Patent [19]

Wiholm

[11] Patent Number: 4,606,689

[45] Date of Patent: Aug. 19, 1986

[54] METHOD AND APPARATUS FOR PRODUCING BOOK COVERS, FOLDERS, BOOKLETS AND THE LIKE

[75] Inventor: Sture H. Wiholm, Johanneshov, Sweden

[73] Assignee: Bind-O-Matic AB, Stockholm, Sweden

[21] Appl. No.: 752,469

[22] Filed: Jul. 5, 1985

[51] Int. Cl.[4] ..... B42C 9/00; B42C 13/00

[52] U.S. Cl. ..... 412/3; 412/8; 412/37; 412/900

[58] Field of Search ..... 412/8, 3, 37, 33, 900, 412/901, 902; 156/230, 232, 578; 264/259

[56] References Cited

U.S. PATENT DOCUMENTS

| | | | |
|---|---|---|---|
| 3,707,418 | 12/1970 | Bhagat et al. | 412/37 |
| 4,266,812 | 5/1981 | Staats | 412/902 |
| 4,289,330 | 9/1981 | Wiermanski | 412/900 |
| 4,353,775 | 10/1982 | Paul | 156/230 |
| 4,367,061 | 1/1983 | Wiholm | 412/3 |

FOREIGN PATENT DOCUMENTS

| | | | |
|---|---|---|---|
| 1159045 | 6/1958 | France | 412/902 |

*Primary Examiner*—Robert L. Spruill
*Assistant Examiner*—Taylor J. Ross
*Attorney, Agent, or Firm*—Dressler, Goldsmith, Shore, Sutker & Milnamow, Ltd.

[57] ABSTRACT

A method of producing a book cover and the like from a blank, the book cover including at least one cover, a spine connected to the cover by at least one crease line, and a bonding agent for adhering pages and the like inserted in the book cover to the inside of the spine, comprising the steps of forming said bonding agent by depositing it as a liquid in a gutter means; cooling said liquid to semi-solid or solid state; aligning said blank to a predetermined position relative to the gutter means; and pressing the blank, the gutter means and the bonding agent in semi-solid state against each other by means of press means to attach the bonding agent to the inside of the spine by adhesion. An apparatus for carrying out the method comprises a substantially horizontal gutter means having two spaced, parallel side walls, a device for deposition of bonding agent in liquid form to said gutter means, drive means for relative displacement between the deposition device and the gutter means during deposition of the bonding agent, and press means for pressing the blank aligned above the gutter means, the gutter means and the bonding agent in semi-solid state against each other to attach the bonding agent to the inside of the spine.

12 Claims, 4 Drawing Figures

METHOD AND APPARATUS FOR PRODUCING BOOK COVERS, FOLDERS, BOOKLETS AND THE LIKE

TECHNICAL FIELD OF INVENTION

The present invention relates to a method and apparatus for producing book covers, folders, booklets or the like having a blank with at least one cover and a spine joined thereto by means of at least one crease line, and a binding agent for bonding sheets or pages inserted in the booklet or covers against the inside of said spine.

BACKGROUND OF THE INVENTION

Book covers, folders and booklets of the kind described above are already known. They generally comprise a cardboard and/or plastics material, which is provided with a spine and two covers joined thereto via two crease lines, said covers enclosing a plurality of sheets of paper. In producing the blank comprising covers and spine, a sheet or roll of material is cut to the desired format, the blank being provided with two crease lines defining the spine. In order that said sheets of paper shall be attached to the spine, it is coated with a bonding agent or binder, subsequent to which the sheets of paper are pushed into the binder, which is then allowed to harden.

Binders of thermosetting type have begun to be used to rationalize the manufacture of folders and booklets. Such a binder is in a solid state at room temperature, and is supplied in large sheets or rolls from which strips are cut. A strip is attached to the inside of the spine by placing it between the crease lines and thereafter heating it so that the binder melts and adheres to the inside of the spine. When the binder has hardened, the book covers are taken to a binding machine such as the one disclosed in U.S. Pat. No. 4,367,116 together with the pages whch are to be enclosed between the covers, with the edges of the sheets in contact with the strip attached to the inside of the spine. The strip is heated by the machine, the edges of the sheets being surrounded by viscous binder. After cooling the sheets are rigidly attached to the spine.

The above-described method of manufacturing folders or booklets is comparatively effective, but necessitates a plurality of work operations. Furthermore, during the process it is difficult to orient the strip exactly on the inside of the spine between the crease lines, which is necessary if all the sheets along the whole of their length are to make contact with the strip and adhere firmly thereto, and if the crease lines are to be kept free from binder and the covers are to be bent as intended, without any obstruction.

A modification of producing the book covers as described above is disclosed in U.S. Pat. No. 4,367,061 wherein the crease lines are formed in the blank at the same time as the binder is adhered to the spine. The main advantages with this method are that the crease lines are formed and the binder is attached to the spine in one single operation and that the binder will be oriented exactly between the crease lines.

Both the above described known methods, however, require that the binder is in solid state and in the form of a strip, which must be manufactured from large sheets or rolls by cutting. Before then such sheets or rolls must be manufactured by melting binder material and forming it to desired widths and thicknesses which often vary for different sizes of book covers.

SUMMARY OF THE INVENTION

The present invention overcomes the problems of the prior art by providing a simple and efficient method and apparatus for producing book covers, folders, booklets and the like, wherein solid strips cut to predetermined sizes from sheets or rolls are no longer required.

The present invention comprises forming said bonding agent by depositing it as a liquid in a gutter means; cooling said liquid to semisolid or solid state; aligning said blank to a predetermined position relative to the gutter means; and pressing the blank, the gutter means and the bonding agent in semisolid state against each other by means of press means to attach the bonding agent to the inside of the spine by adhesion.

The present invention also comprises an apparatus for performing this method.

As used in this specification and claims the expression book covers also comprises folders and booklets and covers, wherein the spine does not need to be integral with full size front and back sides but could be integral with one or two flaps connected to such sides made from material, such as plastics, other than that of the spine, such as cardboard.

DETAILED DESCRIPTION OF THE PREFERRED EMBODIMENTS

Figure 1:
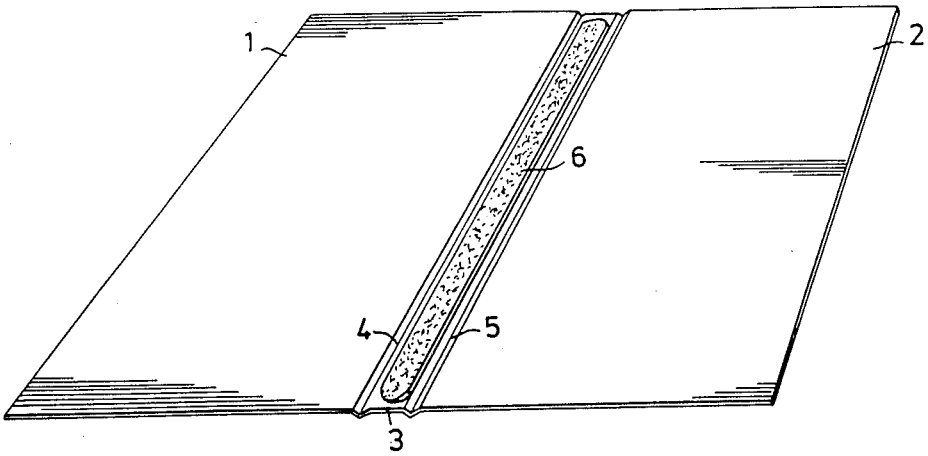
FIG. 1 is a perspective view of a folder produced in accordance with the inventive method, seen from the inside and in a folded-out, flat condition.

The folder illustrated in FIG. 1 and manufactured in accordance with the inventive method comprises a cardboard blank with two covers 1 and 2 and a spine 3, which is connected to the covers via crease lines 4 and 5 extending over the whole height of the folder. On the inside of the spine 3 there is attached a binder in the form of a glue strip 6 in a solid condition. When pages (not shown) are to be fixed in the folder, the sides 1 and 2 are folded upwardly along the crease lines 4 and 5 so that they become substantially mutually parallel, the pages being inserted between the sides 1 and 2 so that longitudinal edges thereof rest against the strip 6. The folder and pages are then inserted in a binding machine (not shown) known per se, where the strip 6 is heated so that the pages penetrate the viscous outer layer of the strip. After the strip 6 has cooled, the pages are firmly connected to the spine 3 of the folder.

Figure 2:
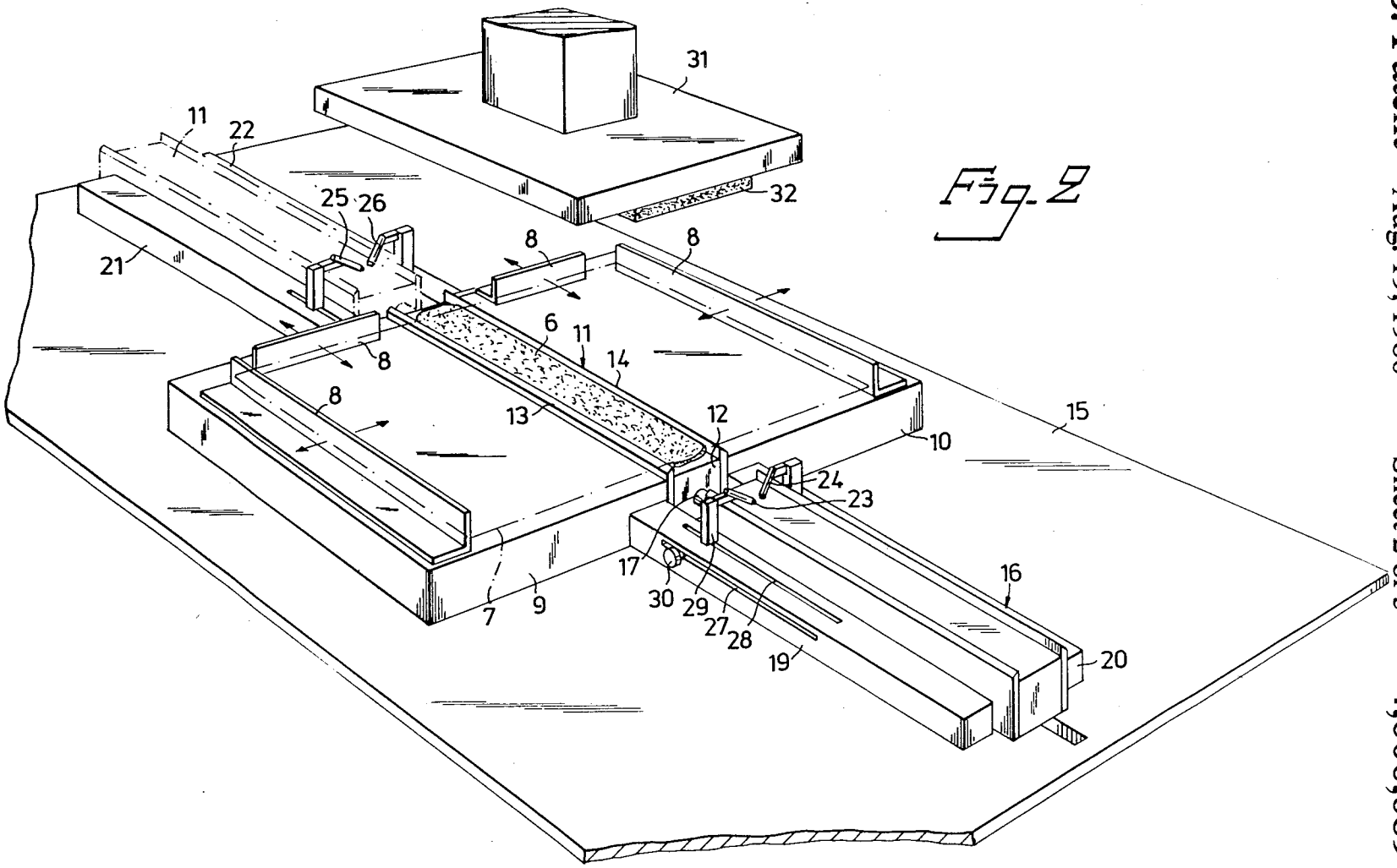
FIG. 2 is a perspective view of an apparatus in accordance with principles of the present invention for carrying out the inventive method.

A flat cardboard blank 7 is indicated by dash-dotted lines in FIG. 2, and the blank is to be provided with crease lines 4, 5 and strip 6. The blank 7 is aligned by displaceable rails 8 into a correct position in a horisontal plane. A bottom plate with two parts 9 and 10 support the outer parts of the blank 7. A first gutter or chute 11 is shown located between the parts 9 and 10 and consists of a bottom bar 12 and two creasing means in the form of side wall metal strips 13 and 14. Gutter 11 and parts 9 and 10 rest on a frame 15. Gutter 11 is movable in its longitudinal direction between parts 9 and 10. A second gutter or chute 16 which is identical to the first gutter 11 and rests on the frame 15 is connected thereto by means of a rod 17. A hydraulic or pneumatic ram 18 is connected to one of the gutters 11, 16 and to the frame 15 (FIG. 3) and arranged to move the gutter 11 between the position shown with full lines and the position shown with dash-dotted lines in FIG. 2 and simultaneously move the gutter 16 between its position shown in FIG. 2 and a position between parts 9 and 10 to replace gutter 11. During this movement the gutters 11, 16 are guided by the parts 9, 10 and by two guide tubes 19, 20 and 21 and 22, respectively, fixed to the frame 15 on each side of these parts.

Nozzles 23, 24, 25 and 26 are arranged on the tubes 19–23 and are movable along these tubes to be held in appropriate positions in relation to the parts 9, 10. The means for making this movement and holding possible comprises two longitudinal slots 27 and 28 in each tube 19–22 and an arm 29 connected to an adjustable screw 30.

A vertically and reciprocally movable press means 31 including a resilient plate 32 is arranged above the space between the parts 9, 10 occupied by the gutter 11 in FIG. 2.

The function of the apparatus shown in FIGS. 2 and 3 will now be described. With the parts of the apparatus in the positions shown in FIG. 2 the ram 18 is actuated at the same time as a bonding agent or binder in liquid form, such as hot melt glue, is ejected from nozzles 23 and 24. During the movement of the gutters 11, 16 to the left in FIG. 2 at a predetermined speed adapted to the ejected amount of bonding agent, the bonding agent will be deposited on the gutter 16 and form a strip therein. To avoid adhesion of the bonding agent to the gutter 16 the inner surfaces of the bottom and side walls thereof are covered by a suitable release agent, such as Teflon.

In order to speed up production, the gutter 16 is cooled before, during and/or after the deposition of the bonding agent in the gutter 16 by any suitable means (not shown), such as a fan blowing cold air against the gutter and/or a cooling element inside the bottom bar. Such a means contributes to the cooling of the bonding agent in order to make it semisolid or solid as soon as possible.

When the right end of the gutter 16 has nearly reached the nozzles 23, 24 the delivery of bonding agent from the nozzles 23, 24 are stopped. The movement of the gutter 16 continues, however, until the gutter 16 is in the position as occupied by the gutter 11 in FIG. 2.

Thereafter, the blank 7 is placed and oriented on the parts 9, 10 and the metal strips of the gutter 16 as shown in FIG. 2, and then the press means 31, 32 is displaced towards the blank and the gutter to form the crease lines 4 and 5 in the blank by the metal strips of the gutter and to adhere the strip of bonding agent on the gutter to the blank between these lines.

At this point of time the viscosity of the bonding agent is preferably semi-solid which has been obtained either by adaptation of the afore-mentioned cooling of the bonding agent or by heating the bonding agent from solid state by means of a heating element (not shown) in the press means 31, 32.

The blank 7 with the bonding agent in form of the strip 6, i.e. the complete folder or cover shown in FIG. 1, is then taken away from the apparatus in any mannner.

Immediately thereafter the ram 18 moves the gutters 11, 16 to the right in FIG. 2. During this movement the nozzles 25, 26 are activated to dispense bonding agent liquid to the gutter 11 until the gutters 11, 16 are in the positions shown with full lines in FIG. 2. After cooling the bonding agent liquid as described above and aligning a blank 7 on the parts 9, 10 and the gutter 11 the press means 31, 32 is displaced downwards to attach the bonding agent strip 6 to the blank and to form the crease lines therein, substantially as described above.

As is evident from the above one of the gutters 11, 16 is receiving bonding agent while the other is moved to a position below the press means 31, 32 irrespectively of which gutter 11 or 16 is receiving the agent. This increases the production velocity.

In a modification of the above described manner of operation the gutter 11 or 16 may receive bonding agent liquid when they are moved away from the parts 9, 10 instead of towards the parts as described above. This will allow the liquid to cool during a longer time than in the above described embodiment.

The points and periods of time at and during which the different operations of the apparatus shall take place are determined by sensing and activating means. Thus, the operations of the ram 18, the nozzles 23–26 and the press means 31, 32 are controlled by such means, including microswitches and/or photocells, for instance, which are conventional and, therefore, will not be further described.

In a further modification of the above described apparatus only one gutter, such as the gutter 11, and two nozzles, such as the nozzles 25, 26, are used. In such an embodiment the gutter 11 is first moved from the outside of the parts 9, 10 (to the left in FIG. 2) and then receives bonding agent from the nozzles 25, 26 and thereafter continues to move into the space between the parts 9, 10. After the press means 31, 32 has been actuated the gutter is moved back to said first position. It is evident that such a modified apparatus will be quite simple and cheap but will work slow mainly because it takes a relatively long period of time to let the bonding agent liquid cool in the gutter before the press means 31, 32 can be activated.

The nozzles 23–26 may consist of conventional spray nozzles or extruders and are connected to a tank (not shown) with heated bonding agent in liquid form. The number of nozzles may be one for each gutter or may be two or more. If two nozzles are used they may be arranged as shown in FIG. 2 or may be arranged in line wth the gutter.

Figure 3:
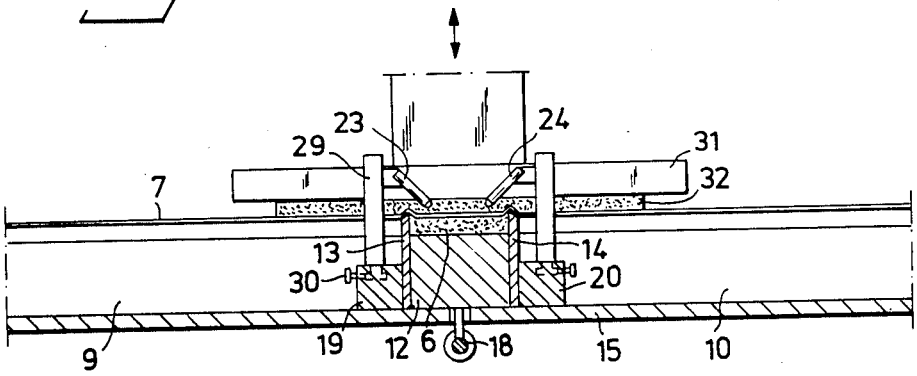
FIG. 3 is a side view, partially in section, of a portion of the apparatus illustrated in FIG. 2.

If covers with another spine width are to be manufactured by the apparatus in FIGS. 3 and 2 the gutters 11, 16 can be replaced by gutters having other widths. In such a case the distances between the parts 9, 10 and between the guide tubes 19, 20 and 21, 22, respectively, are also changed.

Figure 4:
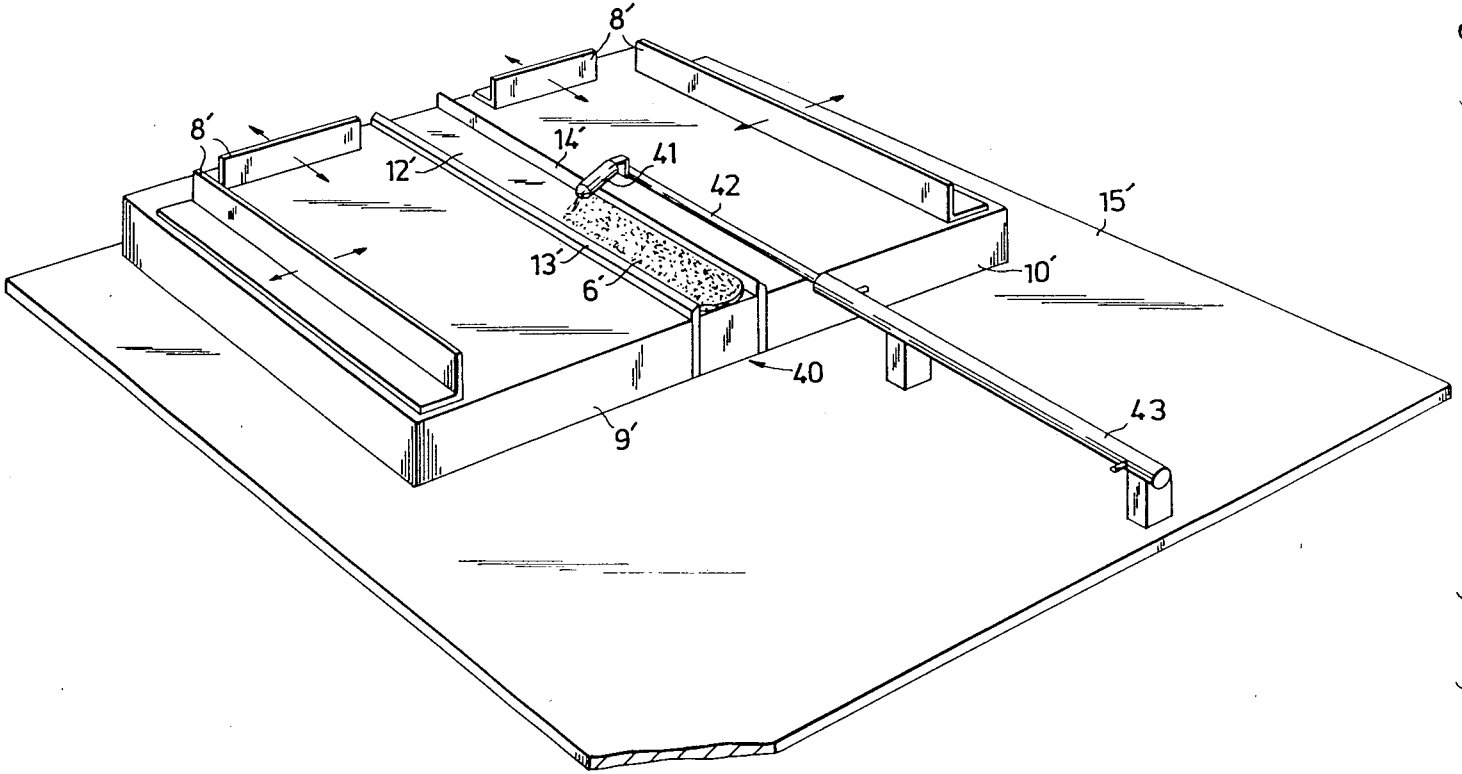
FIG. 4 is a perspective view of a second embodiment of the apparatus in accordance with the invention.

A further embodiment of a portion of the apparatus according to the invention is shown in FIG. 4. Details in FIG. 4 corresponding to details in FIGS. 2 and 3 are denoted with the same reference numbers with the addition of ′ and will not be described. As shown in FIG. 4 a gutter 40 comprising the bottom bar 12′ and the metal strips 13′ and 14′ occupies the space between the parts 9′, 10′. A nozzle 41 is mounted on a piston rod 42 movable in a hydraulic or pneumatic cylinder 43 connected to the frame 15′. By ejecting bonding agent in liquid state, such as a heated thermosetting binder (hot melt glue), from the nozzle 41 when moving the piston rod 42 along and above the stationary gutter 40 in a direction from the right to the left or from the left to the right in FIG. 4 or in both these directions, the gutter 40 receives a predetermined amount of bonding agent liquid. After returning the rod 42 to the far right in FIG. 4 and cooling the bonding agent liquid to a predetermined temperature by letting it cool in the atmosphere and/or by means of any suitable cooling means described above a blank corresponding to the blank 7 in FIG. 2 is positioned on the details 9', 10', 13' and 14' and, thereafter, a press means corresponding to the means 31, 32 shown in FIGS. 2 and 3 are activated to press the blank, the semi-solid strip 6' and the strips 13', 14' together to attach the strip 6' to the blank and to form the crease lines in the blank.

It should be understood that the invention is not limited to the embodiments described above and shown on the drawings and that other embodiments and modifications thereof are possible without departing from the idea of the invention.

The invention is thus only limited to the scope defined in the patent claims.

What is claimed as new and desired to be secured by Letters Patent of the United States:

1. A method of producing book cover and the like from a blank, the book cover including at least one cover, a spine connected to the cover by at least one crease line, and a bonding agent for adhering pages and the like inserted in the book cover to the inside of the spine, comprising the steps of:

forming said bonding agent by depositing it as a liquid in a gutter means;

cooling said liquid to a semi-solid state;

aligning said blank to a predetermined position relative to the gutter means; and pressing the blank, the gutter means and the bonding agent in semi-solid state against each other by means of press means to attach the bonding agent to the inside of the spine by adhesion.

2. A method as recited in claim 1, including depositing said bonding agent as a liquid in said gutter means during relative displacement between said gutter means and an agent deposition device.

3. A method as recited in claim 1, including depositing said bonding agent as a liquid by ejecting it from at least one nozzle.

4. A method as recited in claim 1, including pressing the blank, the gutter means with two longitudinal side walls thereof and the bonding agent against each other to attach the bonding agent to the inside of the spine and simultaneously form two crease lines in the blank to form the cover.

5. An apparatus for producing a book cover and the like from a blank, the book cover including at least one cover, a spine connected to the cover by at least one crease line, and a bonding agent for binding pages and the like inserted in the book cover to the inside of the spine, comprising:

a substantially horizontal gutter means having two spaced, parallel side walls;

a device for deposition of bonding agent in liquid state to said gutter means;

drive means for relative displacement between the deposition device and the gutter means during deposition of the bonding agent; and press means for pressing the blank aligned above the gutter means, the gutter means and the bonding agent in semi-solid state against each other to attach the bonding agent to the inside of the spine.

6. An apparatus as recited in claim 5, comprising a device for cooling the gutter means to a predetermined temperature.

7. An apparatus as recited in claim 5, wherein the deposition device comprises at least one nozzle.

8. An apparatus as recited in claim 5, wherein the deposition device is displaceable above and along said gutter means.

9. An apparatus as recited in claim 5, wherein the gutter means is displaceable relative to the fixed deposition device.

10. An apparatus as recited in claim 5, comprising:

a second gutter means substantially identical with the first mentioned gutter means;

the first and second gutter means being oriented in line with each other and reciprocally displaceable in the direction of said line for alternately receiving bonding agent in liquid state from deposition devices on both sides of the press means and alternately locating the gutter means in line with the motion of the press means.

11. An apparatus as recited in claim 5, wherein the gutter means includes two longitudinal side walls to be pressed against the blank by said pressed means to form the crease lines in the blank simultaneously with the attachment of the bonding agent to the spine to form the complete cover.

12. A method of producing a book cover and the like from a blank, the book cover including at least one cover, a spine connected to the cover by at least one crease line, and a bonding agent for adhering pages and the like inserted in the book cover to the inside of the spine, comprising the steps of:

forming said bonding agent by depositing it as a liquid in a gutter means;

cooling said liquid to a solid state;

aligning said blank to a predetermined position relative to the gutter means;

heating the solid agent to a semi-solid state; and pressing the blank, the gutter means and bonding agent in semi-solid state against each other by means of press means to attach the bonding agent to the inside of the spine by adhesion.

* * * * *